US006256898B1

(12) United States Patent
Trionfetti

(10) Patent No.: US 6,256,898 B1
(45) Date of Patent: Jul. 10, 2001

(54) WORKPIECE-MEASURING APPARATUS, IN PARTICULAR FOR GRINDING MACHINES

(75) Inventor: Gianni Trionfetti, Agrate Brianza (IT)

(73) Assignee: Balance Systems S.p.A., Milan (IT)

( * ) Notice: Subject to any disclaimer, the term of this patent is extended or adjusted under 35 U.S.C. 154(b) by 0 days.

(21) Appl. No.: 09/274,318

(22) Filed: Mar. 23, 1999

(30) Foreign Application Priority Data

Mar. 31, 1998 (IT) ..... MI98A0676

(51) Int. Cl.[7] ..... G01B 7/12; G01B 7/28

(52) U.S. Cl. ..... 33/555.1; 33/551; 33/DIG. 1

(58) Field of Search ..... 33/555.1, 783, 33/784, 792, 803, 804, 805, 807, 808, 501.02, 501.03, 501.04, 549, 550, 551, 552, 553, 555, 558.01, 558.2, 558.4, DIG. 1

(56) References Cited

U.S. PATENT DOCUMENTS 3,962,792 * 6/1976 Stepanek et al. ..... 33/555.1
4,231,158 * 11/1980 Possati ..... 33/555.1
4,669,300 * 6/1987 Hall et al. ..... 33/551
5,005,297 * 4/1991 Aehnelt et al. ..... 33/DIG. 1
5,054,205 * 10/1991 Danielli ..... 33/555.1
5,099,585 * 3/1992 Liskow ..... 33/555.1
5,146,690 * 9/1992 Breitmeier ..... 33/551

* cited by examiner

*Primary Examiner*—Christopher W. Fulton
(74) *Attorney, Agent, or Firm*—Browdy & Neimark

(57) ABSTRACT

A measuring apparatus (1) is provided which has two arms (8) connected to a protection casing (6) through fulcrums (9). Associated with the arms (8), externally of the casing (6), are feeler pins (10) adapted to come into contact with the workpieces (3) and, internally of the casing (6), sensors (11) for measuring the oscillations of the arms (8). Also provided are driving members adapted to exert at least one contact force and one release force tending to rotate the arms (8) in opposite directions and comprising at least one magnet (13) adjacent to the arms (8), magnetic locators (14) integral with the arms (8) and having active faces (14*a*) turned towards the magnet (13), and drive elements (15) adapted to selectively vary the magnet (13) polarities turned towards the magnetic locators (14).

12 Claims, 1 Drawing Sheet

1
2
3
3a
4
5
6
6a
6b
7
8
8a
8b
9
10
11
12
13
14
14a
15
16
16a
17
18
19
20
21
22
23
24
25
26
27
C
S
N

WORKPIECE-MEASURING APPARATUS, IN PARTICULAR FOR GRINDING MACHINES

FIELD OF THE INVENTION

The present invention relates to a workpiece-measuring apparatus, in particular for grinding machines and high-accuracy measurements.

DESCRIPTION OF THE PRIOR ART

It is known that workpieces on machine-tools, in particular grinding machines, can be advantageously measured and checked while machining is going on. This for the purpose of obtaining workpieces that do not require further dimensional checks and that are machined until achievement, as much as possible, of the intended optimal conditions. In this manner many machine shop rejections are avoided, as well as and above all further re-machining that in some cases is required for bringing workpieces machined in an inadequate manner or with insufficient accuracy to a precise size.

For measuring workpieces while they are being machined, typically workpieces having circular sections ground with abrasive grinding wheels, apparatuses are used that have as the active elements two arms emerging from a box-shaped casing generally sealingly closed, in which various members for control and operation of the arms and transducer elements responsive to the angular position of the arms are arranged.

Such arms are capable of oscillating around positions of substantial mutual parallelism and surround the workpieces from diametrically opposite regions, and feeler pins adjustable in position relative to the arms and put directly in contact with the workpieces are interposed therebetween.

Two fundamental positions are imposed to the arms through apparatuses disposed inside the casing. In the first position, the arms keep the feeler pins in contact with the workpieces: it is the work position and for accomplishment of same a set and steady "contact force" is required to be applied to the arms. The contact force is typically obtained by calibrated springs active on the arms from the inside of the casing.

In the second position the arms keep the feeler pins separated from the workpieces: it is the open or "reloading" position and for accomplishment of same a release force is required to be applied to the arms for moving them away from the workpiece, so as to promote positioning of the feeler pins before measurements.

The opening or "reloading" force is typically obtained by pneumatic or electromagnetic members placed within the casing, which act on the arms upon command, so as to move the feeler pins away from the workpieces.

The above described apparatuses have several drawbacks when high-accuracy measurements are to be carried out, i.e. capable of detecting even one-micron tenths in an exactly repeatable manner, and when the initial configuration of the apparatuses is varied.

In fact, springs generating the contact force make high-accuracy measurements of little reliability: actually, it is difficult to calibrate and adjust these springs with accuracy so that they may maintain a light and continuous action and that this action may be the same for all measurements to be carried out.

In addition, the action of the members applying the opening or "reloading" force creates small mechanical shocks reducing the exact-measurement repeatability.

In general all contacts between said arms and the different control and operation members are sources of inaccuracies due to variations in the contact conditions as a result of wear, heat, lubrication, deposit of dust or others.

It is also to point out that when the arms and/or feeler pins are partly changed for adapting them to the workpieces to be measured, the overall weight of the arms is varied, which results in a requirement of new adjustment of the springs generating the contact forces.

Each new adjustment involves opening of said casing, execution of precise operations, restoration of a sealed closure.

The work position of the measuring apparatus must then remain the same as the position set during the adjustment step: each mounting with a different lying relative to the provided one makes it necessary for the springs exerting the contact force to be calibrated again.

SUMMARY OF THE INVENTION

Under this situation, the technical task underlying the present invention is to devise a workpiece-measuring apparatus, in particular for grinding machines, capable of substantially obviating the above mentioned drawbacks.

Within the scope of this technical task, it is an important aim of the invention to devise an apparatus of great accuracy and reliability.

Another important aim of the invention is to devise an apparatus in which both the contact force and the opening force are applied in a rigorously repeatable manner and without generating extra stresses, contact regions varying in time or mechanical shocks.

It is a further aim of the invention to devise an apparatus enabling parts of the arms and/or feeler pins to be changed without operations for opening said casing in view of a new adjustment of the contact force being required.

It is a still further aim of the invention to devise an apparatus adapted to be positioned independently of the direction of action of the force of gravity.

The technical task mentioned and the aims specified are substantially achieved by a workpiece-measuring apparatus, in particular for grinding machines, comprising: two arms oscillatingly supported by fulcrums and having respective work portions, feelers on said work portions for contacting a workpiece, sensors for measuring oscillations of said arms about said fulcrums, and drive means for selectively exerting at least one contact force and at least one release force tending to rotate said work portions of said arms respectively towards and away from said workpiece, wherein said drive means comprise at least one magnet located adjacent to said arms and having opposite polarities, magnetic elements arranged on said arms and having active faces facing said at least one magnet, and means for selectively reversing said polarities of said at least one magnet facing said magnetic elements.

BRIEF DESCRIPTION OF THE DRAWING

Description of a preferred embodiment of an apparatus in accordance with the invention is now given hereinafter, by way of non-limiting example, as illustrated in the accompanying drawings, in which:

FIG. 1 is an elevation view partly in section of the apparatus applied to a workpiece on a machine-tool shown diagrammatically and for illustrative purposes only and.

FIG. 2 schematically shows a detail of another embodiment of an apparatus according to the invention.

DESCRIPTION OF THE PREFERRED EMBODIMENT

Figures 1, 2:
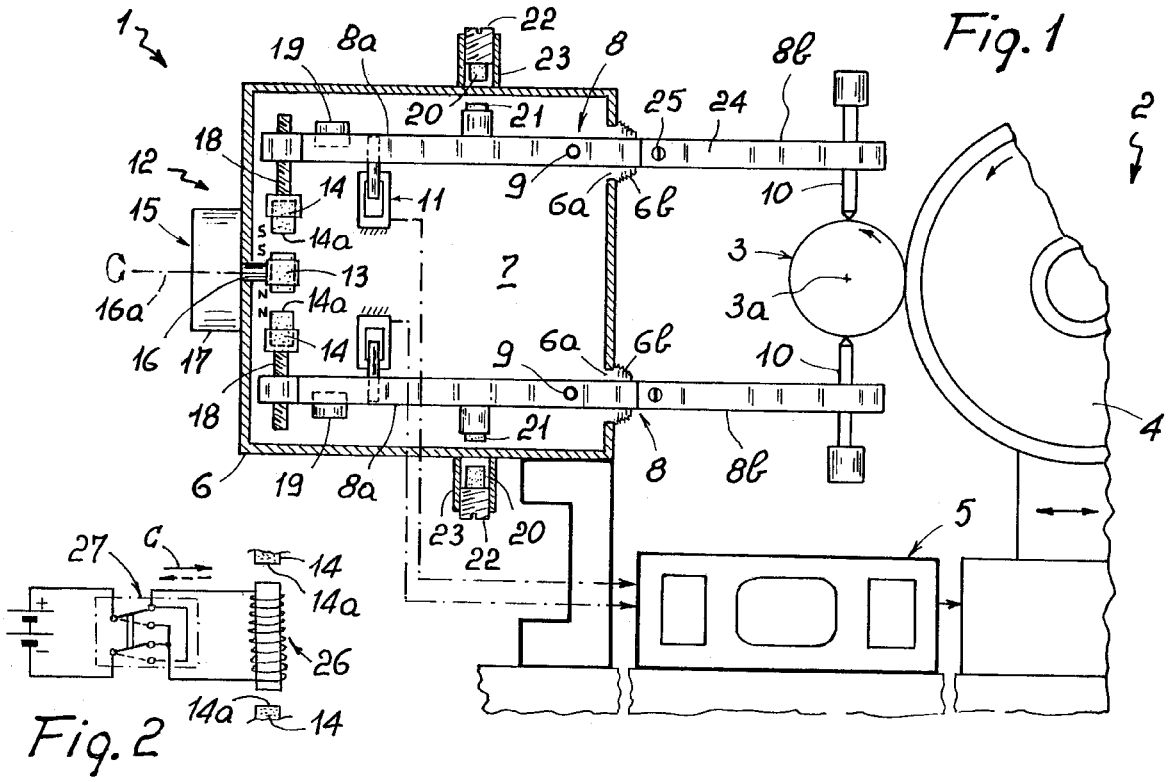

With reference to the figures, the apparatus in accordance with the invention is generally identified by reference numeral 1.

It is preferably applied, as diagrammatically shown in the drawing, to a grinding machine 2, where a workpiece 3 is ground by a grinding wheel 4. In known manner, not shown, workpiece 3 is supported and set in rotation around its extension axis 3*a*.

Machining is checked by an electronic centre 5, receiving signals from apparatus 1, i.e. information about the dimensional features of the workpiece 3 as machining goes on, which information may require an accuracy of one-micron tenth and are to be repeatable with the same results.

Briefly, apparatus 1 comprises a sealingly-closable protection casing 6 of non-magnetic material, in particular of a water-tight type, so as to define a chamber 7 which is substantially insensitive to the conditions existing at the grinding machine 2.

In fact, it is well known that during machining cooling liquids are delivered, and swarf and throw of particles from the grinding wheel and the workpiece are produced that altogether give rise to environmental conditions inappropriate for a precision measuring device.

Casing 6 is passed through by two arms 8 for which openings 6*a* are provided in casing 6, which openings are hermetically closed by seals that in this case are formed of covers or bellows 6*b*.

Arms 8 are connected to casing 6 by means of fulcrums 9: in the example shown fulcrums 9 are substantially horizontal, so that they allow arms 8 to carry out oscillations in substantially vertical planes. At all events, fulcrums 9 are substantially parallel to the rotation axis 3*a* of the workpiece 3 and arms 8 oscillate in planes substantially perpendicular to axis 3*a*.

In addition, advantageously, fulcrums 9 are placed at a position which is about in the middle of arms 8 and close to openings 6*a*.

Arms 8 comprise guide portions 8*a* placed at the inside of casing 6, on one side of fulcrums 9, and work portions 8*b* placed externally of casing 6 and on the other side of fulcrums 9.

The work portions 8*b* surround the workpiece 3 at the ends thereof and support feelers 10 of known type at their end; said feelers 10 can be positioned in a very precise manner and are directly in contact with the workpiece 3 at diametrically opposite points.

The guide portions 8*a* are associated with measuring sensors 11 for evaluating oscillations of arms 8, which consist of transducers for example, such as transducers of the LVDT (Linear Variable Differential Transformer) type. The latter have three coils: one primary coil and two secondary coils concentrated around a movable core, controlled by the displacements of arms 8. The two secondary coils generate an electric signal proportional to the displacement of the movable core and therefore of arms 8. The signal is sent to the electronic centre 5, where it is processed in known manner for suitable operation of the grinding wheel 4, for stopping displacement thereof for example, because the workpiece 3 has exactly reached the desired size.

Acting on the guide portions 8*a* of arms 8 is a drive means 12 adapted to selectively exert forces opposite to each other: a contact force tending to move arms 8 to a work position, i.e. in such a manner that the work portions 8*b* rotate about fulcrums 9 moving close to the workpiece 3, and a release force tending to rotate arms 8 to an open or "reloading" position, i.e. in such a manner that feelers 10 keep a position spaced apart from the workpiece 3.

In more detail, the contact force must be such set that the feelers 10 exert a light and steady pressure on diametrically opposite portions of the workpiece 3.

Just as an indication, this force at each feeler 10 has a value included between one hundred and two hundred grams, preferably between one hundred and twenty and one hundred and fifty grams.

The release force causing opening or reloading of the feelers 10 promotes positioning of the feelers themselves on the workpieces 3 before carrying out measurements. An opening lower than one centimeter at each feeler 10 is widely sufficient.

In accordance with the invention, the drive means 12 comprises at least one magnet 13 adjacent to the guide portions 8*a,* and magnetic elements 14 supported by the guide portions 8*a* and having active faces 14*a* facing towards magnet 13, and drive means 15 adapted to selectively reverse the magnet 13 polarities facing the active faces 14*a*.

In detail, in the particular embodiment shown a single main magnet 13 is provided at a substantially intermediate position between the magnetic elements 14, placed at the ends of the guide portion 8*a* and with their active faces 14*a* that exhibit opposite polarities on the side of the main magnet 13.

Preferably, the main magnet 13 and the magnetic elements 14 are permanent magnets and in particular are small neodymium-iron-boron cylinders obtained by sintering, having a diameter of about five-six millimeters and a length of about six-seven millimeters, provided with high magnetic features, and are preferably disposed in alignment with each other, to a given mutual distance. For example, said small cylinders are provided to be disposed spaced apart from each other a distance of about four-seven millimeters, when arms 8 are parallel to each other.

The drive means 15, adapted to selectively reverse the main magnet 13 polarities facing the active faces 14*a* comprises an overturning pin 16, rigid with the main magnet 13 and defining a rotation axis 16*a* substantially transverse to the magnetic-action line passing through the poles of the main magnet 13 and the magnetic elements 14 and directed substantially parallelly to the arms 8.

The overturning pin 16 passes through the casing 6, and the drive means 15 also comprises an overturning device 17 external to casing 6, rigid with the overturning pin 16 and comprising a rotating cylinder or even a manually controlled handle to be substantially rotated through 180° between two respective end-of-stroke positions.

The magnetic elements 14 are engaged with the guide portions 8*a* through supports 18 the projection of which may be adjusted, in particular through screw adjustment elements.

Due to the advantageous position of fulcrums 9, intermediate between the ends of arms 8, balancing of arms 8 relative to said fulcrums is made possible by means of balancing weights 19 placed on arms 8 within the casing 6. Preferably balancing takes into account all elements connected with arms 8 under operating conditions.

Apparatus 1 is also advantageously provided with auxiliary magnets 20, placed externally of the casing 6, and further magnetic elements 21, supported by the guide portions 8*a* of arms 8 and facing towards the auxiliary magnets 20, from the inside of casing 6 of a non-magnetic material The auxiliary magnets 20 and further magnetic elements 21 as well are preferably permanent magnets of the type already described and the auxiliary magnets 20 can be overturned and fitted into threaded bushes 22 to be screwed down in threaded channels 23 for moving close to and away from casing 6. Overturning enables the auxiliary magnets 20 to be disposed in such a manner that their face turned to the magnetic elements 21 optionally has an N or S polarity.

Finally, as shown in FIG. 1, the work portions 8*b* of arms 8 are provided at their end with end pieces 24 that are removable and interchangeable by means of screws 25.

Operation of the apparatus described above mainly as regards structure is as follows.

During the initial setting step, when casing 6 is still open, arms 8 are balanced by means of the balancing weights 19, so that moments referred to fulcrums 9 are identical in each arm.

Then the supports 18 of the magnetic elements 14 are moved close to the main magnet 13 until about four-seven millimeters therefrom, the main magnet 13 being in the polarity position shown and arms 8 being parallel to each other, so that on each guide portion 8*a* a magnetic repulsion force falling within the limits of the desired contact force measured at the feelers 10 is obtained.

The feelers 10 are positioned in such a manner that between the beginning and the end of the machining operation for grinding of the workplace 3, arms 8 oscillate about their parallelism position. Oscillations usually provided are minimum: under normal work situations the linear displacement of each of the ends of arms 8 is included between one and three millimeters.

The auxiliary magnets 20 are removed from channels 23 or screwed down through bushes 22 at positions relatively very spaced apart from the magnetic elements 21, by a distance of some centimetres for example Afterwards casing 6 is closed and grinding of the workpiece 3 can be carried out: the position variations of arms 8 are detected in a very precise manner by the measuring sensors 11 sending corresponding signals to the electronic centre 5 for checking the machining tool.

At the end of each machining operation, release or reloading of the feelers 10 is obtained in an immediate manner by rotating the main magnet 13 through 180°, by means of the overturning device 17: by reversing the polarities of magnet 13, arms 8 are submitted to a magnetic force in a direction opposite to the preceding one and tending to move the work portions 8*b* away from workpiece 3. On varying of the workpieces 3, it is sufficient to vary the position of the feelers 10 relative to arms 8, so as to restore the optimal conditions in which arms 8 are substantially parallel.

In the cases in which change of the type of feelers 10 used and/or of portions of arms 8, endpieces 24 for example, is required, casing 6 hermetically sealed does not need to be opened, neither do arms 8 need to be rebalanced by means of weights 19.

In fact merely corrective interventions can be carried out from the outside through the auxiliary magnets 20, suitably positioned and screwed down close to casing 6 and to the magnetic elements 21.

Through casing 6 the auxiliary magnets 20 can, depending on the polarity position at which they have been arranged in bushes 22, attract or repel arms 8 in a graded manner compensating for unbalances introduced by changing the feelers 10 and/or endpieces 24 of arms 8.

The invention achieves important advantages.

In fact, very accurate measurements are made possible because the contact and release forces are exerted without mechanical connections, shocks and physical reference elements.

In addition, the arranged magnetic members exert attraction and repulsion actions that are always repeatable in time and the mutual positioning of these members can be carried out in a very precise manner.

In addition, it is possible to operate very precise and efficient corrective interventions from the outside, without opening the casing. If arms are balanced, the apparatus can then be mounted to any position, without any particular precautions.

The invention is susceptible of many modifications and variations, all falling within the scope of the appended claims. Thus magnet 13 for example, instead of being a permanent magnet could be an electromagnet 26 as shown in FIG. 2, in which case the polarity reirsion of the magnet for passing from a repulsion action to an attraction action of arms 8 would be obtained electrically by reversing by conventional switch means 27 the direction C of the supply current of the electromagnet 26.

What is claimed is:

1. workpiece-measuring apparatus, in particular for grinding machines, comprising:

two arms (8) oscillatingly supported by fulcrums (9) and having respective work portions (8*b*), feelers (10) on said work portions (8*b*) for contacting a workpiece (3), sensors (11) for measuring oscillations of said arms (8) about said fulcrums (9), drive means for selectively exerting at least one contact force and at least one release force capable of rotating said work portions (8*b*) of said arms (8) respectively towards and away from said workpiece (3), wherein said drive means comprise:

magnetic elements (14) carried by each of said arms (8), said magnetic elements (14) having active faces (14*a*) having opposite polarities, at least one magnet (13) having opposite polarities and located to cooperate with said active faces (14*a*) of said magnetic elements (14) to create magnetic forces between said at least one magnet (13) and said magnetic elements (14), means (15) for selectively reversing said polarities of said at least one magnet (13) relative to said polarities of said active faces (14*a*) of said magnetic elements (14) to thereby reverse the direction of said magnetic forces for selectively providing said at least one contact force and said at least one release force.

2. An apparatus as claimed in claim 1, wherein said arms (8) are pivotally mounted in a protection casing (6) and have respective guide portions (8*a*) disposed internally of said casing (6), said work portions (8*b*) being substantially external to said casing (6), said magnetic elements (14) being fastened to said guide portions (8*a*) and said at least one magnet (13) being arranged between said active faces (14*a*) of said magnetic elements (14).

3. An apparatus as claimed in claim 1, wherein said at least one magnet (13) and said magnetic elements (14) consist of permanent magnets.

4. An apparatus as claimed in claim 1, wherein said means (15) for selectively reversing said polarities of said at least one magnet (13) comprise an overturning pin (16) rigid with said at least one magnet (13) and defining a rotation axis (16*a*) substantially transverse to a magnetic action line passing through said polarities of said at least one magnet (13), and means for rotating said pin (16) about said axis (16*a*) to reverse said magnetic elements (14) and said at least one magnet (13) facing said magnetic elements (14).

5. An apparatus as claimed in claim 1, wherein said arms (8) are pivotally mounted in a protection casing (6) and wherein said means (15) for selectively reversing said polarities of said at least one magnet (13) comprise an overturning pin (16) rigid with said at least one magnet (13) and defining a rotation axis (16*a*) substantially transverse to a magnetic action line passing through said magnetic elements (14) and said at least one magnet (13), and an overturning device (17) at least partly external to said casing (6) and rigid with said overturning pin (16) for rotating said pin (16) about said axis (16*a*) to reverse said polarities of said at least one magnet (13) facing said magnetic elements (14).

6. An apparatus as claimed in claim 5, wherein said overturning device (17) comprises a cylinder rotatable through 180° between respective end-of-stroke positions.

7. An apparatus as claimed in claim 1, wherein said magnetic elements (14) are adjustable in position relative to said at least one magnet (13).

8. An apparatus as claimed in claim 1, further comprising balancing weights (19) placed on said arms (8) for balancing said arms (8) relative to said fulcrums (9).

9. An apparatus as claimed in claim 1, wherein said arms (8) are pivotally mounted in a protection casing (6) and have respective guide portions (8*a*) disposed internally of said casing (6), the apparatus further comprising auxiliary magnets (20) placed externally of said casing (6) and further magnetic elements (21) rigid with said guide portions (8*a*) of said arms (8) and facing said auxiliary magnets (20), said casing (6) being of non-magnetic material.

10. An apparatus as claimed in claim 9, wherein said auxiliary magnets (20) and said further magnetic elements (21) consist of permanent magnets.

11. An apparatus as claimed in claim 9, wherein said auxiliary magnets (20) are removably fastened to guide bushes (22) screwable towards or away from said casing (6) and said further magnetic elements (21), said auxiliary magnets (20) being selectively fastened with a N or S polarity facing said further magnetic elements (21).

12. An apparatus as claimed in claim 1, wherein said at least one magnet comprises an electromagnet (26) and said means for selectively reversing said polarities of said at least one magnet comprise means (27) for reversing the direction (C) of a supply current of said electromagnet (26).

* * * * *